United States Patent [19]

Sibbertsen

[11] Patent Number: 4,867,380

[45] Date of Patent: Sep. 19, 1989

[54] PISTOL GRIP TYPE COMPRESSED AIR BLOWER

[75] Inventor: Walter Sibbertsen, Hamburg, Fed. Rep. of Germany

[73] Assignee: Mar-Research Gesellschaft fuer Forschung und Entwicklung mbH, Hamburg, Fed. Rep. of Germany

[21] Appl. No.: 227,382

[22] Filed: Aug. 2, 1988

[30] Foreign Application Priority Data

Aug. 3, 1987 [DE] Fed. Rep. of Germany ..... 3725672
Apr. 30, 1988 [DE] Fed. Rep. of Germany ... 8805752[U]

[51] Int. Cl.[4] ..... B05B 7/10

[52] U.S. Cl. ..... 239/405; 239/428.5; 239/472; 239/DIG. 21

[58] Field of Search ..... 239/DIG. 21, DIG. 22, 239/403, 405, 472, 428.5, 491–493, 132.3, 132.5

[56] References Cited

U.S. PATENT DOCUMENTS

| | | | |
|---|---|---|---|
| 1,453,161 | 4/1923 | Murphy et al. | 239/472 |
| 1,547,349 | 7/1925 | Richenbach | 239/405 |
| 3,163,362 | 12/1964 | McFee | 239/405 X |
| 3,884,419 | 5/1975 | Geoffray | 239/DIG. 22 X |
| 3,982,605 | 9/1976 | Snickenberger | 239/DIG. 21 X |
| 4,026,474 | 5/1977 | Knaver et al. | 239/DIG. 22 X |
| 4,187,985 | 2/1980 | Goth | 239/472 X |
| 4,706,888 | 11/1987 | Dobbs | 239/483 X |

FOREIGN PATENT DOCUMENTS

| | | | |
|---|---|---|---|
| 3600147 | 7/1987 | Fed. Rep. of Germany . | |
| 1268876 | 11/1986 | U.S.S.R. | 239/405 |

*Primary Examiner*—Andres Kashnikow

*Assistant Examiner*—Kevin P. Weldon

*Attorney, Agent, or Firm*—Sixbey, Friedman, Leedom & Ferguson

[57] ABSTRACT

The invention relates to a pistol grip type compressed air blower having a handle (2) with a compressed air connection element and an air valve, on which a support body is placed with a turbulence tube (15). On one end section, the support body (26) is formed with a cold air nozzle (18) that has a passage (63) that is coaxial with the center axis of turbulence tube (15) and on an opposite end section, the support body is formed with a warm air nozzle with a hole that is coaxial to the center axis of turbulence tube (15). In some embodiments, the warm air nozzle is adjustable. A turbulence chamber with at least one hole directed tangentially into the interior space of the turbulence chamber is connected between the cold air nozzle (18) and the turbulence tube (15), and receives compressed air via a duct (14) of the handle that is connected to the compressed air connection element via the air valve. Turbulence chamber (40) is formed by a flanged disk that rests on the cold air nozzle (18). The flanged disk has a center hole (42), on one side of which is placed a socket for holding the flanged disk on the cold air nozzle and on the other side of which is formed a continuous outside edge flange (44) in which are formed slot-shaped grooves that tangentially end into a center recess serving as the interior space of the turbulence chamber. The passage of the nozzle body of the cold air nozzle (18) is designed as a diffuser. The cold air nozzle (18) and warm air nozzle (21) may each be detachably connected to a sound damper (82, 83).

24 Claims, 10 Drawing Sheets

Fig. 5
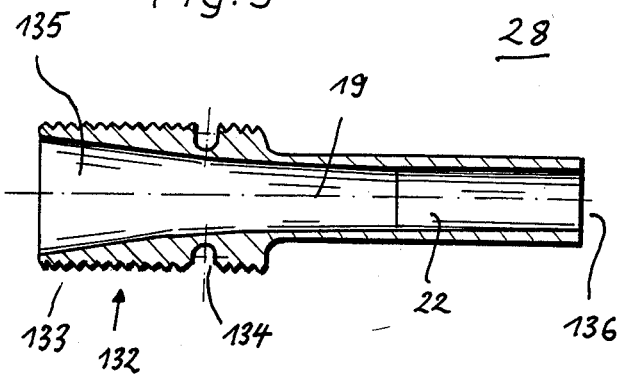
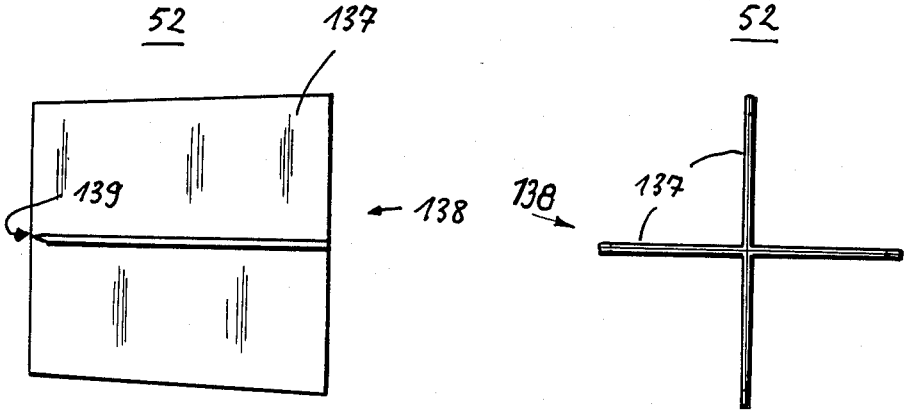
Fig. 6a
Fig. 6b

Fig.17
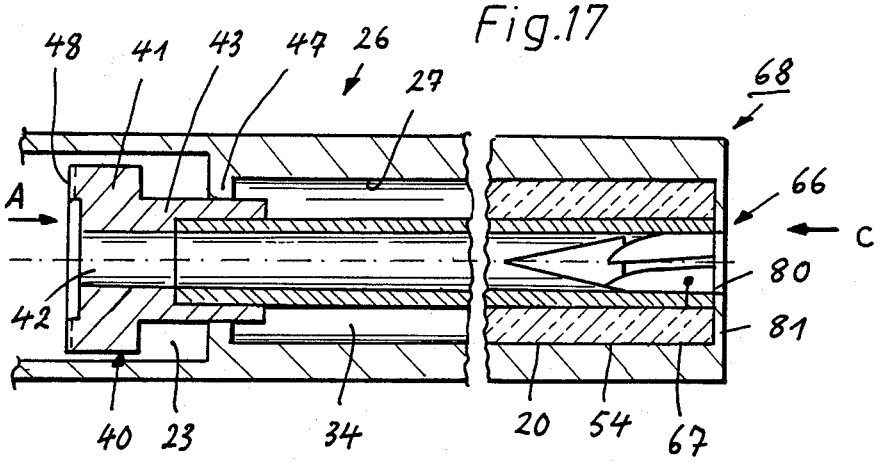
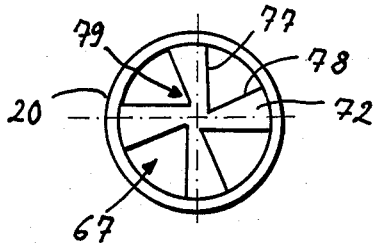
Fig.18
Fig.19
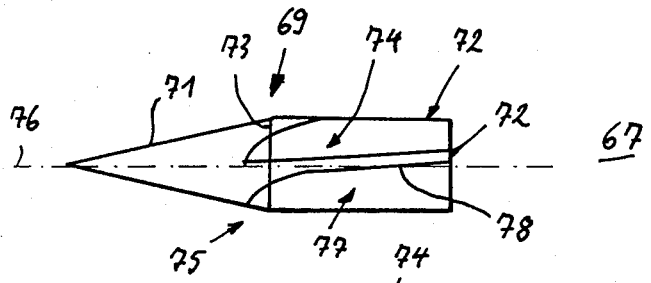
Fig.20
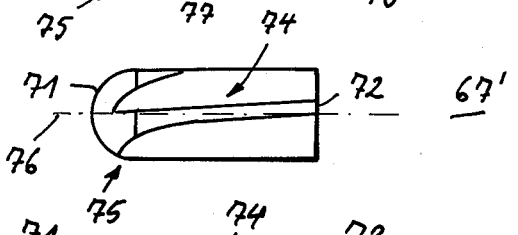
Fig.21
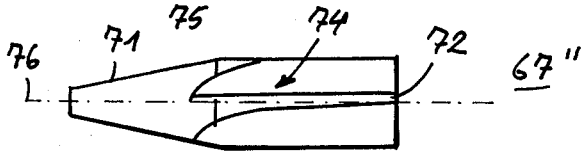

PISTOL GRIP TYPE COMPRESSED AIR BLOWER

BACKGROUND OF THE INVENTION

The invention relates to a pistol grip type compressed air blower having a body with a connection element for a compressed air feed hose, an air valve for controlling the feeding of compressed air, a cold air nozzle, a warm air nozzle and a turbulence tube formed between the cold and warm air nozzles.

Such a compressed air blower is known from German Offenlegungsschrift No. 36 00 147. However, with this blower it has turned out to be disadvantageous that operation of the cold air nozzle is possible in only a limited temperature range and adaptation to other temperature ranges can be made only with difficulty. Another disadvantage of this known compressed air blower is that, at high air throughflows, a considerable production of noise takes place which is bothersome when the compressed air blower is used.

SUMMARY OF THE INVENTION

Thus, it is a primary object of the present invention to improve a compressed air blower of the initially mentioned type so that it ma be operated over a wide cold air temperature range and with reduced noise production even at high air throughflows. It is also an object to enable the uses to which the blower may be put to be increased by virtue of its ease of operation.

The objects of the invention are attained by providing the turbulence tube with a turbulence chamber that is designed as a flanged disk that rests on a cold air nozzle. The flanged disk has a center hole that is coaxially aligned with a passage extending axially through the body of the cold air nozzle. On one side of its center hole, the flanged disk has a socket for holding the cold air nozzle and on its opposite side is placed an outside edge flange with a center recess. Slot-shaped grooves are formed in the edge flange that end tangentially at the center recess of the edge flange that serves as the interior space of the turbulence chamber. Furthermore, the passage through the nozzle body of the cold air nozzle is designed as a diffuser and both the cold air nozzle and the warm air nozzle may each be detachably connected to a sound damper.

In embodiments with an adjustable warm air nozzle, the action of the compressed air blower can be determined by turning the warm air nozzle which acts as a throttle. If the warm air nozzle is closed, the compressed air blower operates like an ordinary compressed air apparatus. The temperature of the air coming from the cold air nozzle drops only when the warm air nozzle is opened. Once the exact throttle setting is established, it can be used repeatedly with constant pressure of the compressed air. It is possible, in regard to the temperature of the compressed air, to achieve a temperature reduction of about 45° C. and more, and the temperature of the air coming from the warm air nozzle is raised only insignificantly. For a locally limited cooling of surfaces, the cold air nozzle can be provided with hose-like extension pieces.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 5 shows the hot air nozzle in a side sectional view;

FIGS. 6*a* and 6*b* show a flow rectifier in a side and top view, respectively;

FIG. 17 shows the turbulence tube of the compressed air blower according to FIG. 16 in an enlarged side sectional view;

FIG. 18 is an enlarged end view of the tubular body according to FIG. 17 as seen in the direction of arrow C; and FIGS. 10 to 21 illustrate different configurations of a multiple diffuser for the compressed air blower according to FIG. 16 in diagrammatic side views.

DETAILED DESCRIPTION OF THE PREFERRED EMBODIMENTS

Figure 1:
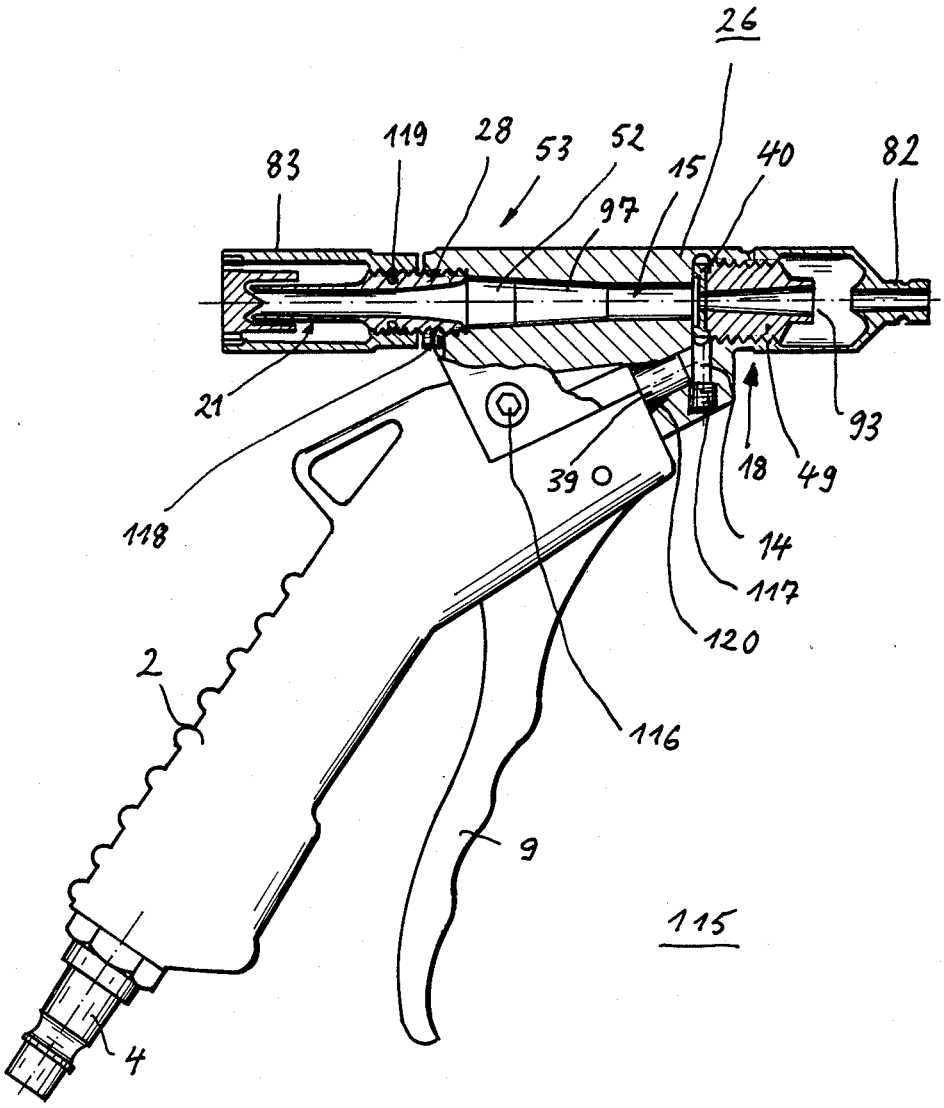
FIG. 1 shows a configuration of a compressed air blower with a support body solidly mounted on a handle in a partial sectional side view.

Compressed air blower 115, represented in FIG. 1, consists of a piston grip handle 2 and a support body 26. Handle 2 has a hose coupling 4 to which a compressed air hose can be connected. In the handle is an air valve of conventional design (not further shown, but similar to that of the later described embodiments) which can be actuated by trigger level 9. Compressed air is fed, by ducts 39, 14 from the handle to the support body 26, to a turbulence chamber 40 of a turbulence tube 15 formed in support body 26. Duct 14 is closed off from the environment by set screw 117. Support body 26 is connected to handle 2 by a screw connection 116. A nozzle body 49 of a cold air nozzle 18 is screwed by thread 130 into thread 122 of a recess 94 (FIG. 2*a*) of support body 26, and a noise damper 82 is screwed onto nozzle body 49 so that the cold air discharge opening 93 of nozzle body 49 is inside sound damper 82. Turbulence tube 15, in a direction toward a warm air nozzle 21, is formed with a duct section 121 of constant cross section, to which is connected a widening duct section forming a diffuser 97. On the widened end of section 121 is a recess 124 having a thread 125 into which nozzle body 28 of warm air nozzle 21 is connected by thread 133 and then clamped on support body 26 by a set screw 118. A sound damper 83 is screwed over nozzle body 28, with a seal ring 119 interposed therebetween to prevent uncontrolled discharge of compressed air in the area of the screw coupling of sound damper 83 with nozzle body 28. Another seal 120 is provided in the area of duct 39 and seals handle 2 relative to support body 26. This seal 120 can be made, for example, as a silicone hose coupling or the like.

Figure 2D:
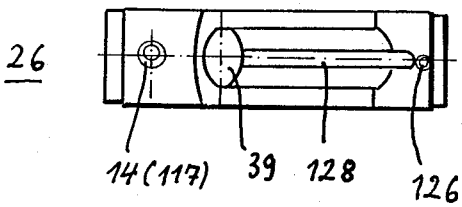
FIGS. 2*a* to 2*d* show the support body of the blower according to FIG. 1 in side sectional, rear and front end elevation, and bottom plan views, respectively, the front of the support being shown in FIGS. 2*a* and 2*d* pointing in an opposite direction relative to that in FIG. 1.
Figure 2A:
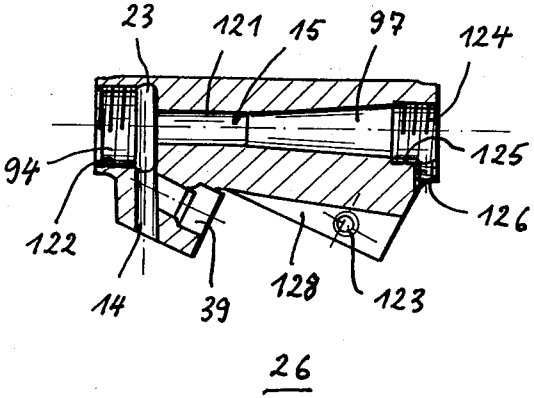
Figure 2B:
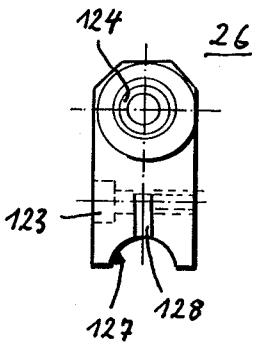
Figure 2C:
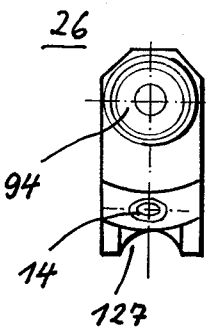

With reference to FIGS. 2*a* and 2*d*, it can be seen that support body 26 is made of a one-piece construction having the turbulence tube 15 with the recesses and holes necessary for connection means. An annular chamber 23, in which turbulence chamber 40 is situated, is connected to duct 14 and to recess 94. In the lower section of support body 26 is formed a recess 127 as well as slot 128. Recess 127 and slot 128 serve to receive corresponding shapes formed on pistol grip handle 2, and hole 123 is provided in this area for a screw connection 116. Duct 139 is widened on its input side and serves for receiving seal 120.

Figure 3A:
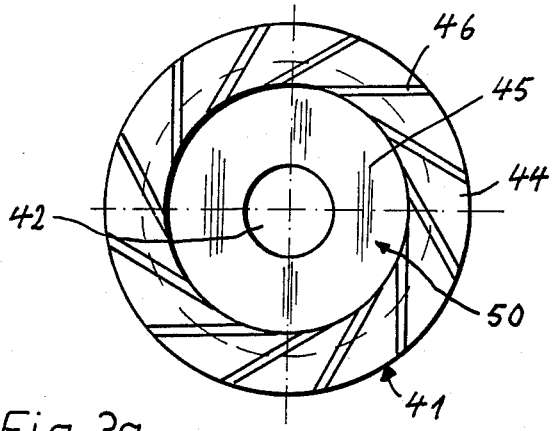
FIGS. 3*a* to 3*c* show the turbulence chamber of the compressed air blower according to FIG. 1 in different views.
Figure 3B:
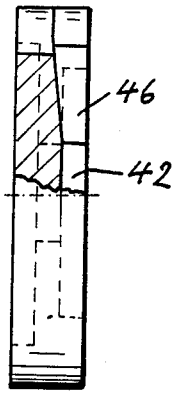
Figure 3C:
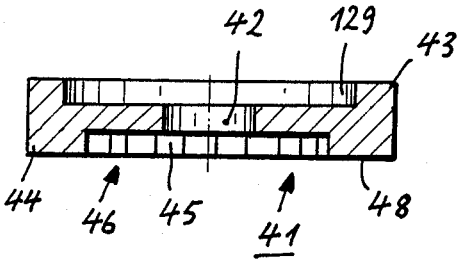

A flanged disk 41 is shown in FIGS. 3*a* to 3*c*, and forms a turbulence chamber inside space 50 by insertion into annular chamber 23 of support body 26. Flanged disk 41 has a center hole 42, on one side of which a socket 43 forms a recess 129. A shoulder 96 of nozzle body 49 of cold air nozzle 18 is inserted with a tight fit into this recess 129. An outside edge flange 44 is formed on the opposite side of flanged disk 41 from socket 43 and forms a recess 45, that is connected to hole 42, that serves to form the interior space 50 of the turbulence chamber. Grooves 46 are formed in edge flange 44 at uniformly spaced intervals, for example, 30°, and end tangentially in recess 45. In the assembled condition, front area 48 of edge flange 44 rests on the bottom of recess 94 of support body 26. It is possible to make grooves 46 spiral or semicircular of a uniform or tapering nozzle-like cross section.

Figure 4A:
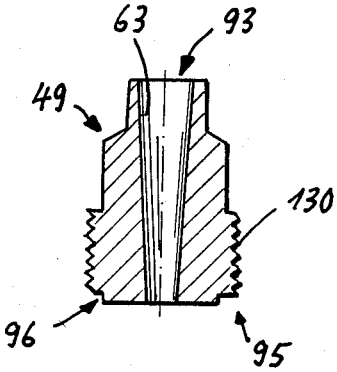
FIGS. 4*a* to 4*c* show the cold air nozzle of the blower according to FIG. 1 in different views.
Figure 4B:
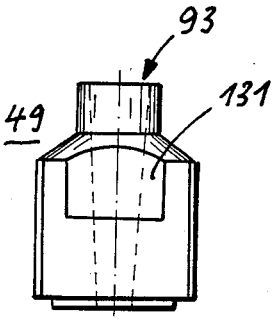
Figure 4C:
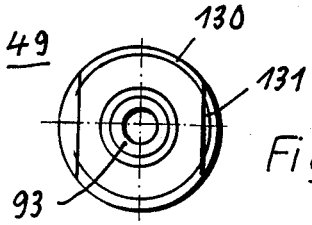

Nozzle body 49 of cold air nozzle 18 of compressed air blower 115, as represented in FIGS. 4*a* to 4*c*, is of a one-piece construction having a passage 63 formed as a diffuser. The passage 63 has an inside wall with a slope of, e.g., 1:10. A flange 96 is formed on an end section 95 that is opposite the cold air discharge opening 93 and serves (as already mentioned above) for receiving flanged disk 41. On the periphery of nozzle body 49 are provided two plane wrench stop surfaces 131, which serve for resting a tool for turning nozzle body 49 in support body 26.

The nozzle body 28 (FIG. 5) for warm air nozzle 21 has a holding section 132, on which the thread 133 is formed. Further, holding section 132 is provided with a circular groove 134, which serves to receive seal ring 119. Nozzle body 28 also has a hole 22 with an intake section 135 which, in a preferred embodiment, is widened like a trumpet in a direction toward the duct section 121 of turbulence tube 15. Intake section 135 may have other cross-sectional shapes, but it is essential that hole 22 widen in cross section toward turbulence tube 15. The intake section 135 of hole 22 is connected to a duct section, which has a constant cross section and extends to warm air discharge opening 136.

A flow rectifier 52 is shown placed on the end section of diffuser 97 of turbulence tube 15 of compressed air blower 115 in FIG. 1 and is represented diagrammatically in FIGS. 6*a* and 6*b*. This flow rectifier 52 consists of four plates 137 of the same size that are connected at right angles to one another at a crosspiece 138. Intake side edges 139 of plates 137 are tapered like a knife, so that stagnation of the flow of compressed air into this area is prevented.

Figure 7:
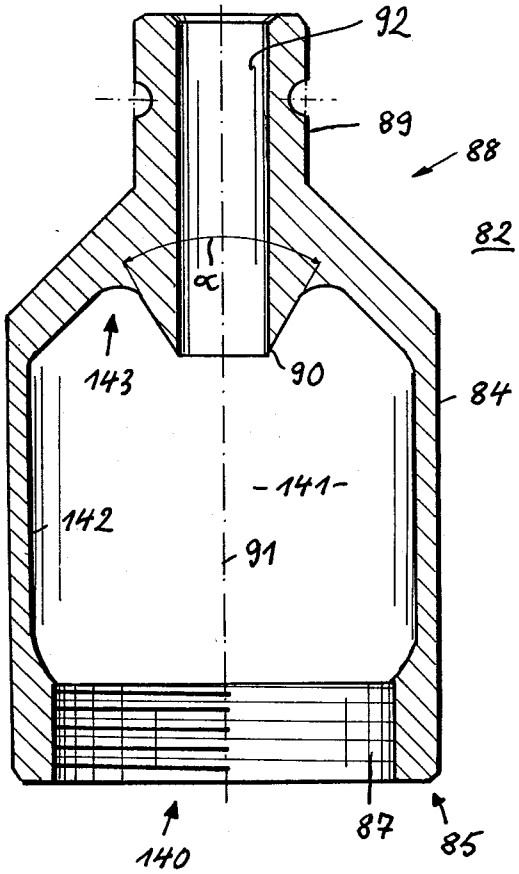
FIG. 7 shows a sound damper for the cold air nozzle in a side sectional view.

Sound damper 82 for cold air nozzle 18 is represented in FIG. 7, and is in the form a bushing 84, which has an end section 85 of reduced internal diameter which has an internal thread 87 for connection to external thread 130 of nozzle body 49. From its intake opening 140, bushing 84 widens to a reversing chamber 141. The end of the side wall 142 of reversing chamber 141 located opposite intake opening 140 forms a circular groove-like recess 143 in conjunction with a taper 90 of the chamber outlet. The ends of side wall 142, as well as the bottom recess 143, are made rounded to avoid turbulences. The outside wall of taper 90 is frustoconical and can, e.g., exhibit an angle of opening of 60°. At an outlet end section 88 of bushing 84, the bushing is externally tapered to a connection 89 within which a throughhole 92 is provided, coaxially with respect to center axis 91, that extends through taper 90 into reversing chamber 141. By the flow reversals brought about in reversing chamber 141, a reduction of the sound pressure of the cold air coming from the cold air discharge opening 93 of nozzle body 49 is achieved.

Figure 10:
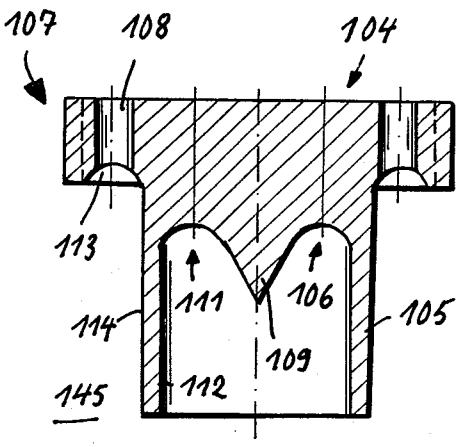
FIG. 10 shows a flow reversing part of the sound damper of the warm air nozzle for the housing according to FIG. 8, in a side sectional view.
Figure 8:
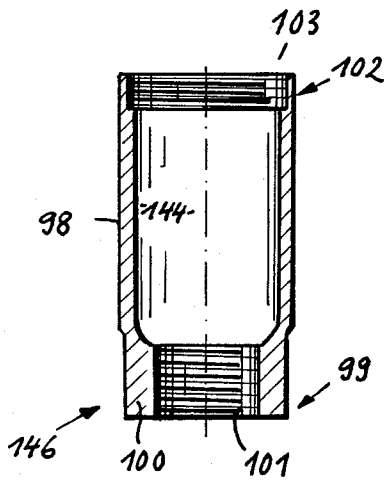
FIG. 8 shows the housing of the sound damper of the warm air nozzle in a side sectional view.
Figure 9:
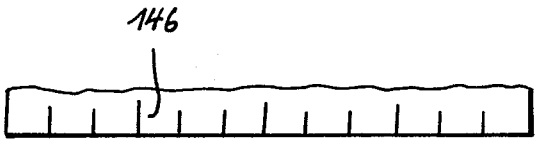
FIG. 9 shows a scale formed on the housing according to FIG. 8.

The sound damper 83 for the warm air nozzle is formed of two parts, which are represented in FIGS. 8 to 10. A sleeve-like hollow body 98 (FIG. 8) has an end section 99 in which a portion 100 is provided with an internal thread 101 and reduced internal diameter, similar to end section 85 of damper 82. The internal thread 101 matches the external thread 133 on holding section 132 of nozzle body 28. The portion 100 widens into a hollow space 144, which serves for the formation of a reversing chamber. On the other end section 102 of hollow body 98, a tapped hole 103 is formed, into which a reversing part 145 can be screwed. Reversing part 145 (FIG. 10) consists of a plate 104, on which is formed a sleeve 105 that projects into hollow body 98 and encompasses the discharge end of nozzle body 28 with clearance in the assembled configuration, as shown in FIG. 1. Bottom surface 106 of sleeve 105 forms a flow reversing section 111. For this purpose, inside wall surface 112 of sleeve 105 is converted into a circular bottom surface which is connected to a nozzle cone 109 that is coaxially positioned relative to the center axis of sleeve 105. In the installation of reversing part 145 in hollow body 98, nozzle cone 109 extends into the discharge opening 136 of hole 22 of nozzle body 28 of the warm air nozzle (FIG. 1). Circular holes 108, which serve as air discharge openings, are provided in outside edge 107 of plate 104. To reduce turbulences, in the area of the transition of outside surface 114 to plate 104, a circularly shaped groove 113 is provided with a semicircular cross section in the bottom of which holes 108 end.

Reversing part 145 can be shifted relative to the discharge opening of hole 22 by turning of hollow body 98 on holding section 132 of nozzle body 28. In some cases, it is possible to cut off flow through warm air nozzle 21 by nozzle cone 109. Scale 146, which, e.g., can be made as a line engraving (FIG. 9), is provided on the outside surface of hollow body 98 in the area of portion 100 to facilitate setting of the degree to which warm air nozzle 21 is open.

The compressed air blowers, described below, are represented, in each case, without sound damper 82, 83. However, it is possible to provide these compressed air blowers with sound dampers 82, 83, as they were described above. In connection with these further embodiments, prime (') designations are used to indicate those items which correspond to elements of the FIG. 1 embodiment in a modified form.

Figure 11:
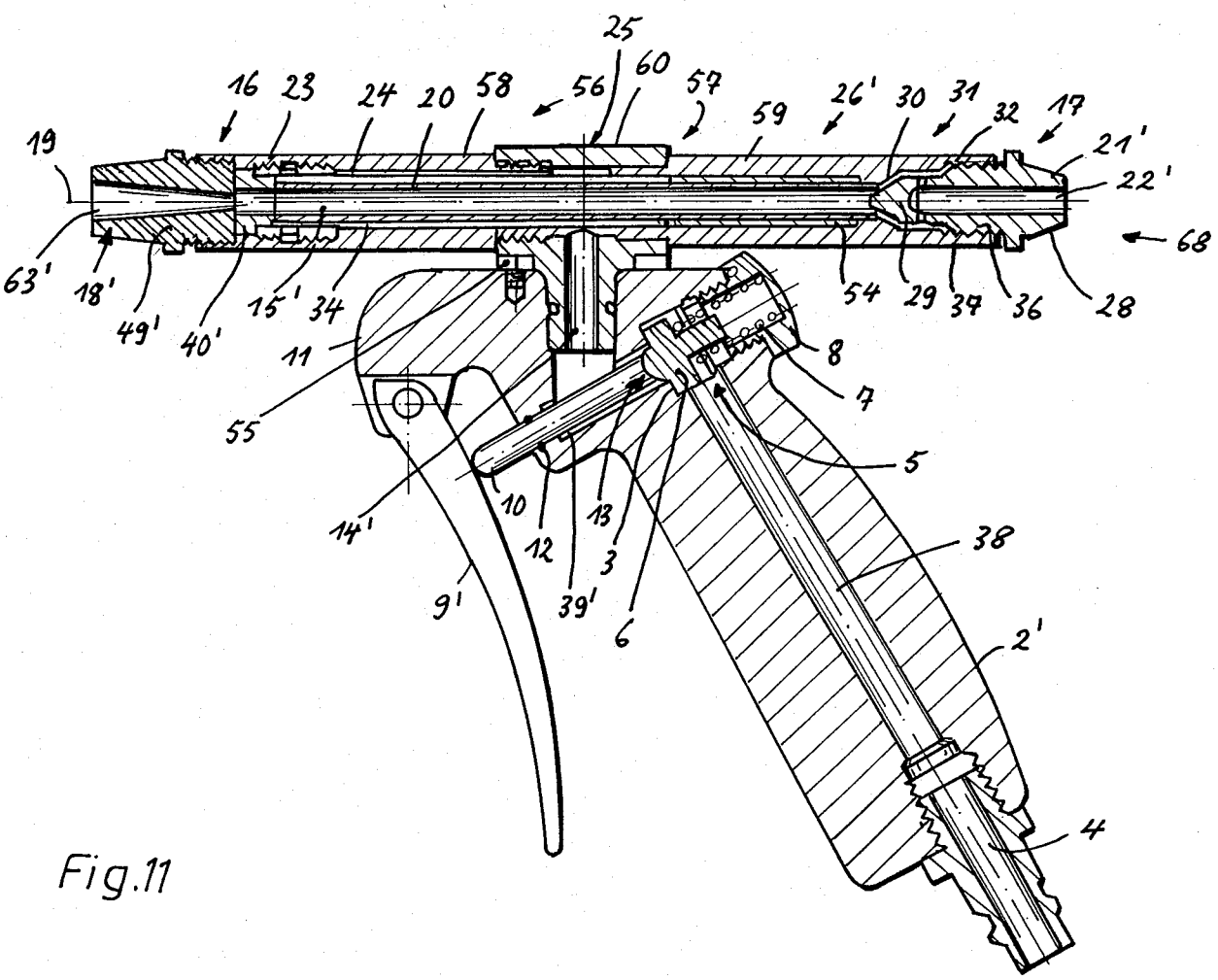
FIG. 11 shows another embodiment of a compressed air blower in accordance with the invention in a side view in section.

Compressed air blower as presented in FIG. 11 has a pistol grip handle and a support body 26', in which a turbulence tube 15' is placed. In handle 2', a duct 38 is formed, which can be connected at one end to a compressed air hose (not further represented) by a hose coupling 4, and has an air valve 5 placed on the other end of duct 38. This valve 5 consists of a valve cone 6, which is pressed by a valve spring 7 onto a valve seat 3. The initial tension of valve spring 7 can be set by a setscrew 8. Outlet 13 of valve seat 3 is connected to a duct 39' through which plunger 10 is guided. Plunger 10 can be actuated by a trigger lever 9' that is pivotally mounted on a housing 11 of handle 2'. Plunger 10 is sealed by an 0-ring seal 12. Compressed air can be introduced into turbulence tube 15' from duct 39' through a turbulence chamber 40'.

Figures 12, 13, 14:
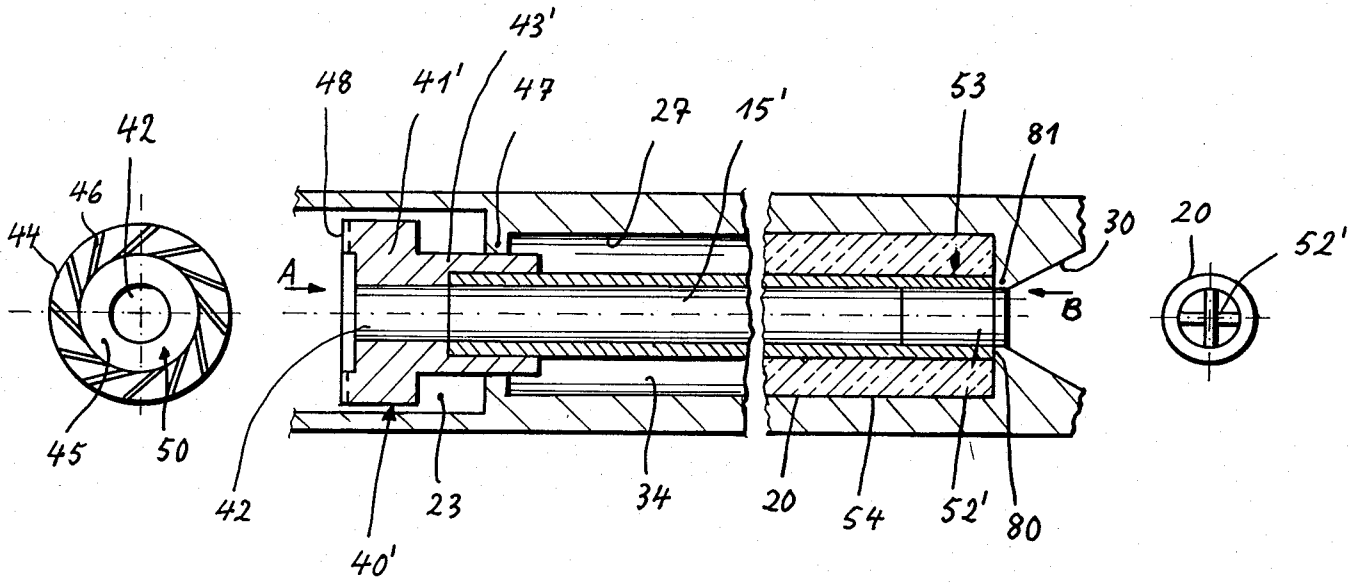
FIG. 12 shows the turbulence tube, having a tubular body and a turbulence chamber, of the compressed air blower according to FIG. 11 in a simplified side sectional representation.
FIG. 13 shows the turbulence chamber in a view taken in the direction of arrow A in FIG. 12.
FIG. 14 shows the tubular body in a view taken in the direction of arrow B in FIG. 12.

Support body 26' is formed of a connection piece 60 having a housing holder 25, into which a tubular body 58, 59 is screwed at each of opposite axial sides. A cold air nozzle 18' is screwed onto the free end section of tubular body 58, and a warm air nozzle 21' is screwed onto the free end section of tubular body 59. Housing holder 25 is a T-shaped connection piece 60, which is rotatably screwed into housing 11 of handle 2'. Housing 11 is formed with a stop 55 on which side surfaces of ends 56, 57 of connection piece 60 can be alternatively brought to rest by rotating support body 26' in one direction or the other about the center axis of duct 14'. As a result, support body 26' can be turned 180 in either direction, so that either cold air nozzle 18' or warm air nozzle 21' is directed forward. Duct 14' is connected to duct 39 and another duct 24, formed in support body 26'. Tubular body 20 of turbulence tube 15 is mounted in duct 24, and forms with wall 27 of tubular body 58, an annular duct 34. In the area of a free end section 16 of tubular body 58, spacers 47 are formed, in which a flanged disk 41', forming turbulence chamber 40, is mounted (FIGS. 11 and 12).

Flanged disk 41' is provided with a center hole 42, one end of which socket 43' formed. Tubular body 20 of turbulence tube 15' is introduced into socket 43'. In the surface of flanged disk 41' that faces away from socket 43', a recess 45 is formed by a continuous outside edge flange 44 that is provided with slot-shaped grooves 46, which end tangentially in recess 45 (FIG. 13). An annular chamber 23, from which compressed air flows via grooves 46 into recess 45, is formed in tubular body 58 between spacers 47 and flanged disk 41'. With built-in cold air nozzle 18', recess 45 forms the interior space of 50 of the turbulence chamber in which a turbulent air current is formed.

Nozzle body 49' of cold air nozzle 18' has a central passage 63', which is made as a diffuser. In this case, the diameter of hole 63' in the inlet area of the nozzle body 49' is smaller than the diameter of recess 45 and hole 42 (in comparison to passage 63 on nozzle 49 which is the same size as hole 42 in disk 41 of the first embodiment). Thus, the inlet of hole 63 forms an orifice.

In the area of tubular body 59, a jacket tube 45, which consists of a heat insulating material, is drawn over tubular body 30, within annular duct 34. As a result, heat transfer from the hot air in tubular body 20 to the exterior surface of tubular body 59 is limited.

With the end section of tubular body 20 facing toward warm air nozzle 21', two plates, placed at right angles to each other, are provided as a flow rectifier 52' that extends parallel to center axis 19 (FIGS. 12, 14). It is also possible to make flow rectifier 52' as a grid, cross, or the like.

On warm air section 17, warm air nozzle 21' has a nozzle body 28 with a center duct 22'. This duct 22' is made as a blind hole and is connected on an inside end section of nozzle body 28' with other radially extending holes. These holes connect duct 22' with an annular chamber 32, which is formed between nozzle cone 29 and the end side section of tubular body 59. Nozzle cone 29 has a seal ring and is movable relative to conical nozzle seat 30 by actuation of nozzle body 28 to increase and decrease the extent to which its external thread 36 is screwed into internal thread 36 of tubular body 59. Thus the output of warm air can be varied depending on the setting of warm air nozzle 21.

Depending on the desired cooling effect, tubular body 20 of turbulence tube 15' can be provided with different inside diameters in the area of cold air nozzle 18. The greater the inside diameter, the greater is the cooling effect.

Figure 15:
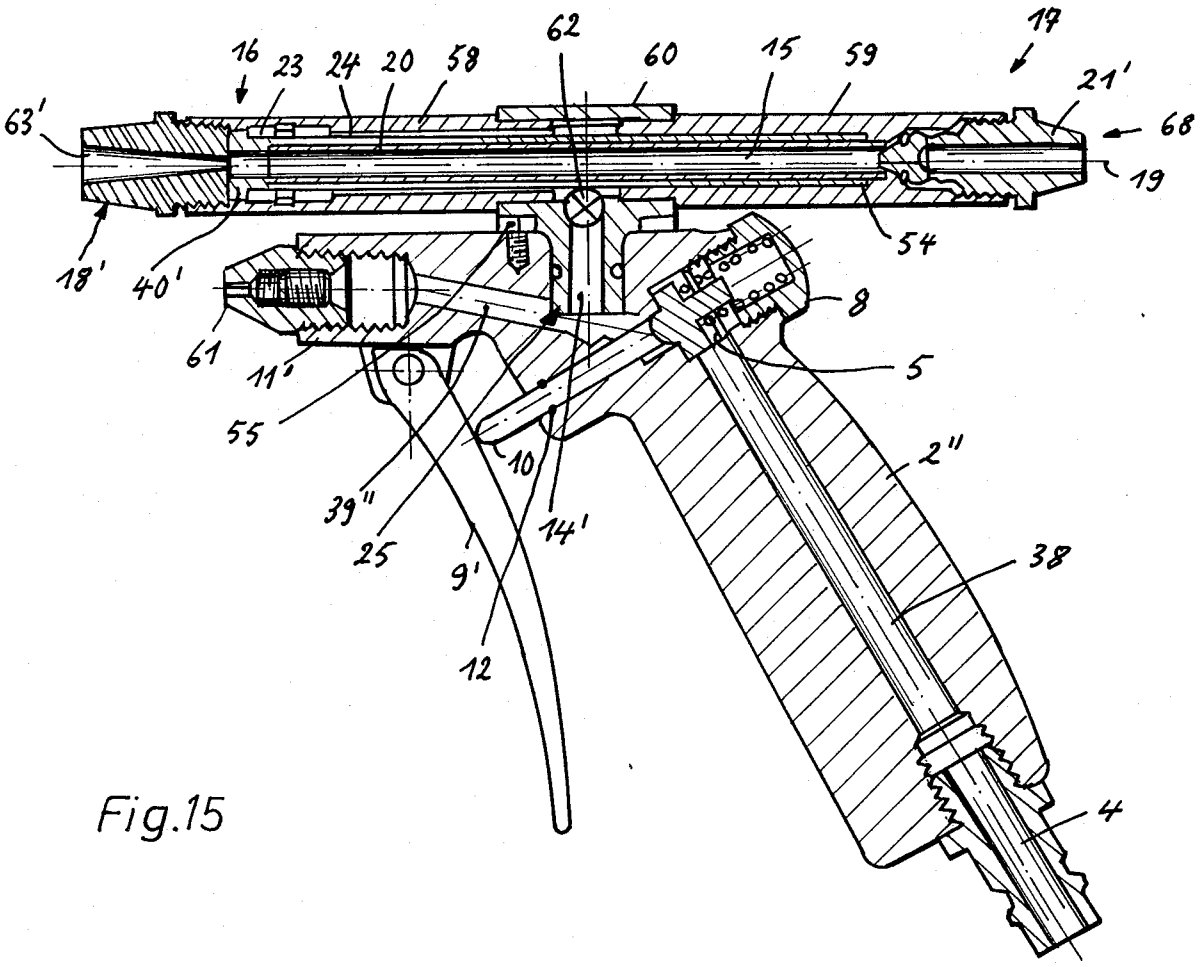
FIGS. 15 and 16 are side sectional views of other configurations of compressed air blowers in accordance with the invention.

FIG. 15 shows a modification of the FIG. 11 compressed air blower, in which a duct 39' is made so that, in addition to duct 14', it is also connected to a closable nozzle 61, which is formed in housing 11' of handle 2''. Untreated compressed air can be blown from compressed air blower 65 through this nozzle 61. For this case, a shutoff device 62 can be provided in connection piece 60 to cut off duct 14' when nozzle 61 is to be put into operation. A greater range of application is offered for the compressed air blower by this configuration. Otherwise, this embodiment is the same as that described relative to FIGS. 11–14.

It is also possible to make the warm air nozzle end section of tubular body 20 sufficiently reduced in cross section that it serves as a throttle so that in conjunction with a modified flow rectifier, under certain conditions, incorporation of nozzle body 28 can be eliminated.

Figure 16:
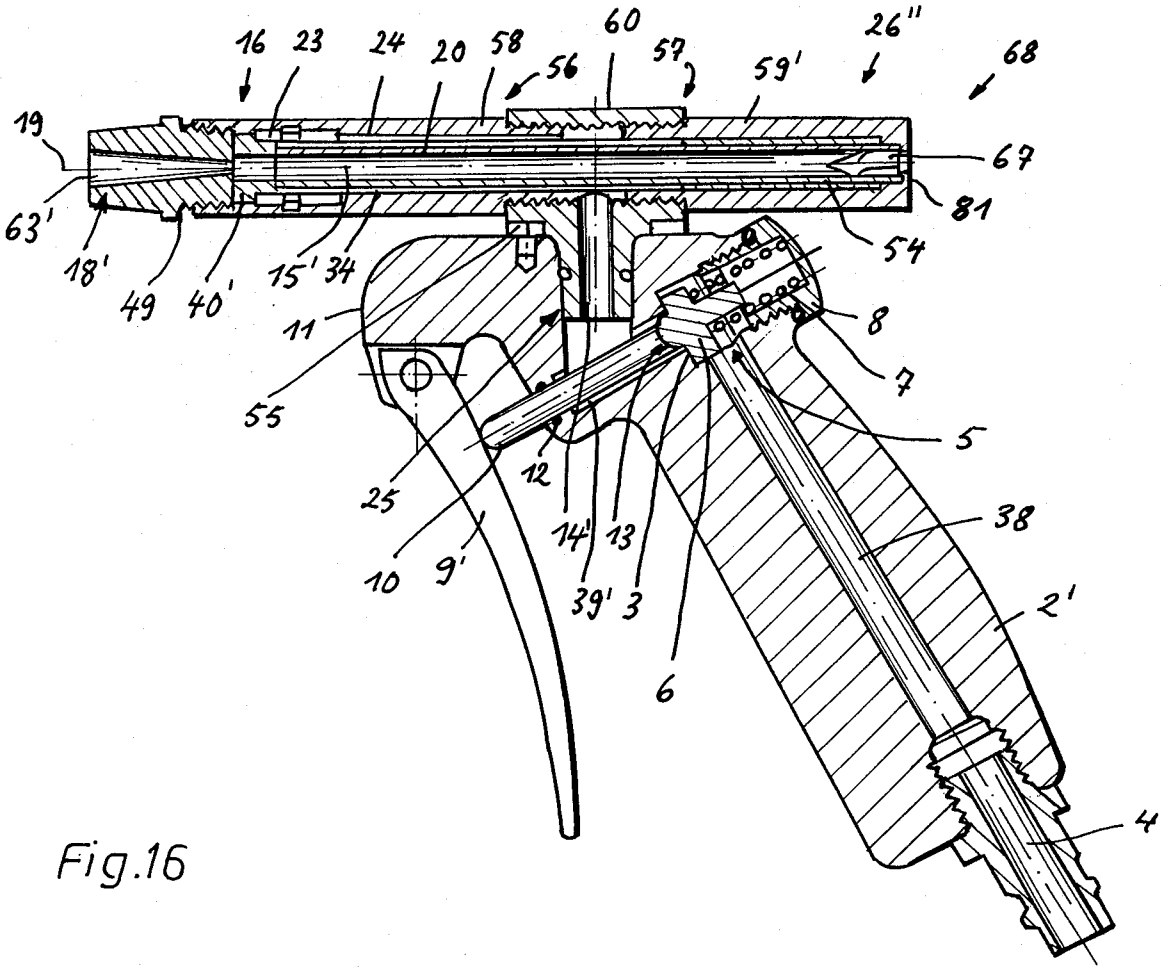

FIG. 16 shows such a compressed air blower, in which, with the use of a throttle type nozzle, instead of the adjustable warm air nozzle 21', the hot air output is optimized. A multiple diffuser 67 is placed on end section 66 of tubular body 20 at opposite turbulence chamber 40, and is used as a warm air side throttle type nozzle 68. Front surface 80 of tubular body 20 rests on a circular end flange 81 of a support body 26'', whose tubular body 59' can be shortened in comparison with tubular body 59 of FIGS. 11, 15.

Multiple diffuser 67 consists of a basic body 69, which is made of a one-piece construction. Basic body 69 has a flow conducting surface 71 on an upstream end. Radial flanges 72 are provided adjacent to flow conducting surface 71, and are formed on the downstream end of basic body 69. These flanges 72 extend radially as far as the largest diameter 73 of flow conducting surface 71. Grooves 74, formed between flanges 72, widen crosssectionally in the flow direction of gas flowing through tubular body 20. Intake sections 75 of grooves 74 are placed in the area of the largest diameter portion of flow conducting surface 71. Further, grooves 74 are aligned at a slight angle to center axis 76 of basic body 69. In each groove 74, one side wall 77 is planar and the other side wall 78 is concavely arched in the flow direction. The two side walls 77, 78 meet one another at bottom 79 of groove 74. In this case, said walls 77, 78 are placed at an angle of less than 90° relative to one another. Flanges 72 exhibit a triangular cross section that generally decreases in the flow direction of the gas flowing through tubular body 20.

Other embodiments of the multiple diffusers, 67', 67'', are represented in FIGS. 20 and 21. While the arrangement and configuration of grooves 74 and flanges 72 are identical in each case, flow conducting surface 71 differs. That is, the flow conducting surface can be conical 71, spherical 71' or frustrum-shaped 71''. It is also possible to chose a pyramid shape with or without a vertex. The specific shape of multiple diffuser 67 depends on the dimensioning of turbulence tube 15 as well as the warm air side optimizing criteria that have to be considered.

While I have shown and described various embodiments in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Pistol grip type compressed air blower comprising a pistol grip like handle with a compressed air connection element and an air valve; a support body mounted on said handle and provided with a turbulence tube; a cold air nozzle having a nozzle body disposed at a first end of said turbulence tube and having a passage coaxially aligned with a center axis of the turbulence tube; a warm air nozzle disposed at an opposite end of said turbulence tube relative to said first end and having a hole coaxially aligned relative to the center axis of the turbulence tube; and a turbulence chamber with at least one hole directed tangentially into an interior space of the turbulence chamber that is mounted between said turbulence tube and said cold air nozzle, wherein the turbulence tube is connected to a duct leading to the air valve compressed air connection element via said turbulence chamber; wherein said turbulence chamber comprises a flanged disk with a center hole on one side of which a socket for holding the flanged disk on said cold air nozzle, and on an opposite side of which is formed an outside edge flange with a center recess serving as the interior space of the turbulence chamber, said outside edge flange being provided with slot-shaped grooves that end tangentially in said recess serving as the interior space of the turbulence chamber; wherein said passage of the nozzle body of cold air nozzle has a diffuser shape.

2. Compressed air blower according to claim 1, wherein said warm air nozzle is adjustable.

3. Compressed air blower according to claim 2, wherein a sound damper is detachably connected to each of the cold air and warm air nozzles.

4. Compressed air blower according to claim 3, wherein the sound damper connected to the cold air nozzle is in the form of a bushing having a first end section of reduced interior diameter with an internal thread for threaded engagement with an external thread formed on said nozzle body, and wherein an opposite, discharge, end section of the bushing is formed internally with a tapering flow reversing element with a discharge opening formed coaxially therethrough, said flow reversing element being spaced at a distance from a cold air discharge opening of said passage of the cold air nozzle body.

5. Compressed air blower according to claim 4, wherein the diameter of the discharge opening of said bushing is smaller than the diameter of said cold air discharge opening.

6. Compressed air blower according to claim 1, wherein the nozzle body of the cold air nozzle is disposed in a recess of the support body, and has a shoulder, on an end facing away from the cold air discharge opening, on which said socket of the flanged disk is shoved with a tight fit; and wherein said edge flange of the flanged disk rests on a bottom wall of a recess in an end of the support body.

7. Compressed air blower according to claim 4, wherein the sound damper for the warm air nozzle is in the form of a hollow body having air discharge openings and a flow reversing device, and is mounted over a nozzle body of the warm air nozzle in a manner enabling displacement thereof coaxially relatively to the center axis of the turbulence tube.

8. Compressed air blower according to claim 4, wherein the nozzle body of the warm air nozzle has a hole, which widens in a direction toward said turbulence tube.

9. Compressed air blower according to claim 7, wherein a section of said turbulence tube directed toward the nozzle body of the warm air nozzle is made in the form of a diffuser.

10. Compressed air blower according to claim 7, wherein the sound damper for the warm air nozzle comprises a sleeve-shaped hollow body, having a first end section of reduced internal diameter with an internal thread for threaded engagement on an external thread formed on the warm air nozzle body; and wherein an opposite end section of the hollow body is closed by a plate on which is formed a sleeve which projects into said hollow body in spaced surrounding relationship relative to said warm air nozzle body, a bottom surface of said sleeve being formed as a flow reversing section; and wherein holes are formed in an outside edge of said plate as warm air discharge openings from said hollow body.

11. Compressed air blower according to claim 10, wherein a nozzle cone is formed on said bottom surface of said sleeve that is coaxial with respect to the center axis of the turbulence tube, said nozzle cone having a surface that smoothly merges into said bottom surface, and wherein said bottom surface is circularly concavely arched and merges smoothly into an interior peripheral wall surface of the sleeve.

12. Compressed air blower according to claim 1, wherein said turbulence tube has a center tubular body which is placed in a duct of said support body; wherein said support body is rotatably connected to said handle by means of a housing holder which is engageable, at each of opposite sides thereof, by a stop formed on the handle; wherein an outlet of said air valve is connected to the turbulence chamber of the turbulence tube by a duct formed in said housing holder and an annular duct is formed between a wall of said duct of the support body and the circumference of said tubular body; wherein the tubular body is solidly fixed in the socket formed on said first side of the flanged disk; and wherein said socket of the flanged disk is held by spacers projecting inwardly from the wall of the support body in a manner creating a path along which air can flow over an outside edge of the flanged disk, through the grooves formed therein, and into the interior space of the turbulence chamber.

13. Compressed air blower according to claim 1, wherein a flow rectifier in the form of a grid, cross, or the like is placed in an end section of the turbulence tube which faces away from said turbulence chamber.

14. Compressed air blower according to claim 12, wherein a section of the tubular body, between the duct of the housing holder and the warm air nozzle, is surrounded by a casing of heat insulating material, which fills a corresponding portion of said annular duct.

15. Compressed air blower according to claim 12, in which the warn air nozzle has a nozzle body with a hole that is coaxial with the center axis of the turbulence tube and a nozzle cone that can be pressed on a nozzle seat, wherein the nozzle seat is formed on a warm air discharge end of the duct of said support body.

16. Compressed air blower according to claim 12, wherein said warm air nozzle is formed by a throttle element placed on a warm air end section of the support body; and wherein said throttle element is a multiple diffuser which is placed in an end section of the tubular body facing away from said turbulence chamber and consists of a one-piece basic body; wherein a rotationally symmetric flow conducting surface is formed on an upstream end of said basic body, said flow conducting surface being formed with a cross-sectional area that decreases in an upstream direction relative to air flow thereover; wherein a downstream end of said basic body is formed with flanges extending radially as far as a largest diameter end of the flow conducting surface, said radially extending flanges forming grooves running axially from said flow conducting surface that have a cross section which widens in said air flow direction; wherein an incoming section for said grooves is formed in the area of said largest diameter flow conducting surface; and wherein said flanges having a triangular cross section that generally decreases in the flow direction.

17. Compressed air blower according to claim 16, wherein said grooves are aligned at a slight angle relative to a center axis of basic body.

18. Compressed air blower according to claim 16, wherein one side wall of each groove is planar and an opposite side wall thereof is concavely arched in the flow direction; and wherein said side walls of the groove meet one another at a bottom of each groove.

19. Compressed air blower according to claim 18, wherein the side walls of the grooves are oriented at an angle of less than 90° relative to one another.

20. Compressed air blower according to claim 16, wherein the multiple diffuser is placed on an end section of the tubular body, a front end surface of said end section resting on a circular end flange of the support body.

21. Compressed air blower according to claim 12, wherein the support body is formed of a tubular body which is mounted in the housing holder.

22. Compressed air blower according to claim 12, wherein the support body comprises a first tubular body connected to the cold air nozzle, a second tubular body connected to the warm air nozzle and a connection piece for the tubular bodies on which said housing holder is formed.

23. Compressed air blower according to claim 1, wherein the duct of the handle is connected to a second duct, formed in a housing of the handle, a closable nozzle being placed on an outside end section of said second duct, and wherein a shutoff device is provided in the support body for blocking air flow from the handle duct.

24. Compressed air blower according to claim 1, wherein the diameter of the passage of the cold air nozzle body in the area of the flanged disk is smaller than the center hole of the flanged disk.

* * * * *